US005704176A

United States Patent [19]

Greenberg

[11] Patent Number: 5,704,176

[45] **Date of Patent: *Jan. 6, 1998**

[54] SNAP-ON COPING HOLDDOWN

[75] Inventor: Percy Greenberg, St. Louis Park, Minn.

[ * ] Notice: The term of this patent shall not extend beyond the expiration date of Pat. No. 5,673,523.

[73] Assignee: Crown Partnership, Anoka, Minn.

[21] Appl. No.: 598,729

[22] Filed: Feb. 8, 1996

Related U.S. Application Data

[63] Continuation-in-part of Ser. No. 293,467, Aug. 19, 1994.

[51] Int. Cl.[6] ..... E04H 12/00

[52] U.S. Cl. ..... 52/300; 52/718.04; 52/58

[58] Field of Search ..... 52/300, 58, 718.04

[56] References Cited

U.S. PATENT DOCUMENTS

| | | | |
|---|---|---|---|
| Re. 28,870 | 6/1976 | Attaway et al. | 52/58 X |
| 2,554,779 | 8/1951 | Goodwin | 52/300 |
| 3,802,140 | 4/1974 | Hickman | 52/300 |
| 3,818,663 | 6/1974 | Adlam | 52/300 |
| 3,862,531 | 1/1975 | Attaway et al. | 52/58 X |
| 4,083,158 | 4/1978 | Wolma | 52/300 |
| 4,858,406 | 8/1989 | Lane et al. | 52/300 |
| 4,890,426 | 1/1990 | Hickman et al. | 52/300 X |
| 4,964,248 | 10/1990 | Braine et al. | 52/300 X |
| 5,289,662 | 3/1994 | Castle | 52/300 X |

*Primary Examiner*—Wynn E. Wood
*Assistant Examiner*—Aimee E. McTigue
*Attorney, Agent, or Firm*—Nawrocki, Rooney & Sivertson

[57] ABSTRACT

An improved wall coping system including a coping member and underlying support member anchored to a wall. The wall coping support member is secured to the wall and extends beneath the coping member for support of the coping member along its length.

8 Claims, 4 Drawing Sheets

SNAP-ON COPING HOLDDOWN

CROSS REFERENCES TO CO-PENDING APPLICATIONS

This application is a continuation-in-part of U.S. patent application Ser. No. 08/293,467, filed Aug. 19, 1994, entitled "Snap-On Coping Holddown", to the same assignee as the present application.

BACKGROUND OF THE INVENTION

The present invention relates to wall coping systems. More particularly, the present invention relates to an improved snap-on coping system for the top of a parapet or similar wall.

Parapet walls are low protective walls typically located along the edge of building roofs. Coping systems are used to cover the top of parapet walls and protect the walls from undesirable entry of outside elements, particularly moisture. Coping systems also provide an aesthetically pleasing finish for the top of the wall.

Typical prior art wall coping systems require the use of numerous members including an anchor plate, a splice plate, a gasket, seal members, and coping members. The anchor plate is located along the wall where the edges of two coping members meet and secures the coping system to the top of the parapet wall. A neoprene spacer or compression pad is attached to the top of the anchor plate, and a splice plate is secured over the compression pad on top of the anchor plate. The coping members are formed to "snap-fit" over the splice plate and anchor plate. An end of each coping member is sealed to the top of the splice plate using a waterproof sealant, with the ends of the coping members being located at the center of the splice plate. Even when effective, the costs of fabricating these several parts and assembling them at the construction site are high.

In addition to fabrication and construction costs, the coping system described above has experienced many problems. For example, the splice plate tends to sag in the middle due to its own weight. Water often enters the space between the ends of the coping members and collects on the splice plate. The water freezes and thaws with the changes in outside temperature causing damage to the coping system and its seals. The damaged coping system allows moisture to pass around and through the coping system and into the parapet wall, which ultimately results in damage to the wall.

Other problems occur due to the fact that the coping members are only supported at their ends. The coping members lack uniform structural support and integrity along their length. As a result, the coping members lack structural soundness and tend to sag in the middle. When the coping members sag, water tends to collect or "pond" along the surface of the coping members. The lack of structural integrity and resulting "ponding" is very undesirable.

Wall coping systems have been improved in an attempt to remedy these problems. For example, the coping system shown in U.S. Pat. No. 5,289,662 to Castle includes structural reinforcement of the splice plate. The reinforced splice plate is constructed so it will not sag and is also configured to provide additional protection for sealant located between the coping members and the splice plate. Although this system addresses sagging of the splice plate, it requires additional parts and labor. Additionally, such improvements have not addressed the problem resulting from the lack of structural support along the length of the coping member, and resulting sagging of the wall coping members and surface ponding.

SUMMARY OF THE INVENTION

The present invention provides an improved wall coping system employing a "snap-fit" coping member similar to that used in prior art systems. In particular, the wall coping system of the present invention provides a support member underlying the coping member to provide continuous support to the coping member along its length. The support member is secured to the top of the wall in any desired manner and the coping member is "snapped" over the support member to affix the coping member in position. The number of parts forming the copying system are reduced while assembly of the coping system is simplified. In a preferred embodiment, the support member includes a compression element which provides generally continuous upward urging on the copying member along its length.

BRIEF DESCRIPTION OF THE DRAWINGS

In the drawings, like reference numerals indicate corresponding parts or elements of the present invention throughout the several views:

FIG. 5 is a sectional view of a third embodiment of a snap-on coping system in accordance with the present invention.

FIG. 6 is a sectional view of a fourth embodiment of a snap-on coping system in accordance with the present invention.

DETAILED DESCRIPTION OF THE PREFERRED EMBODIMENTS

Figure 1:
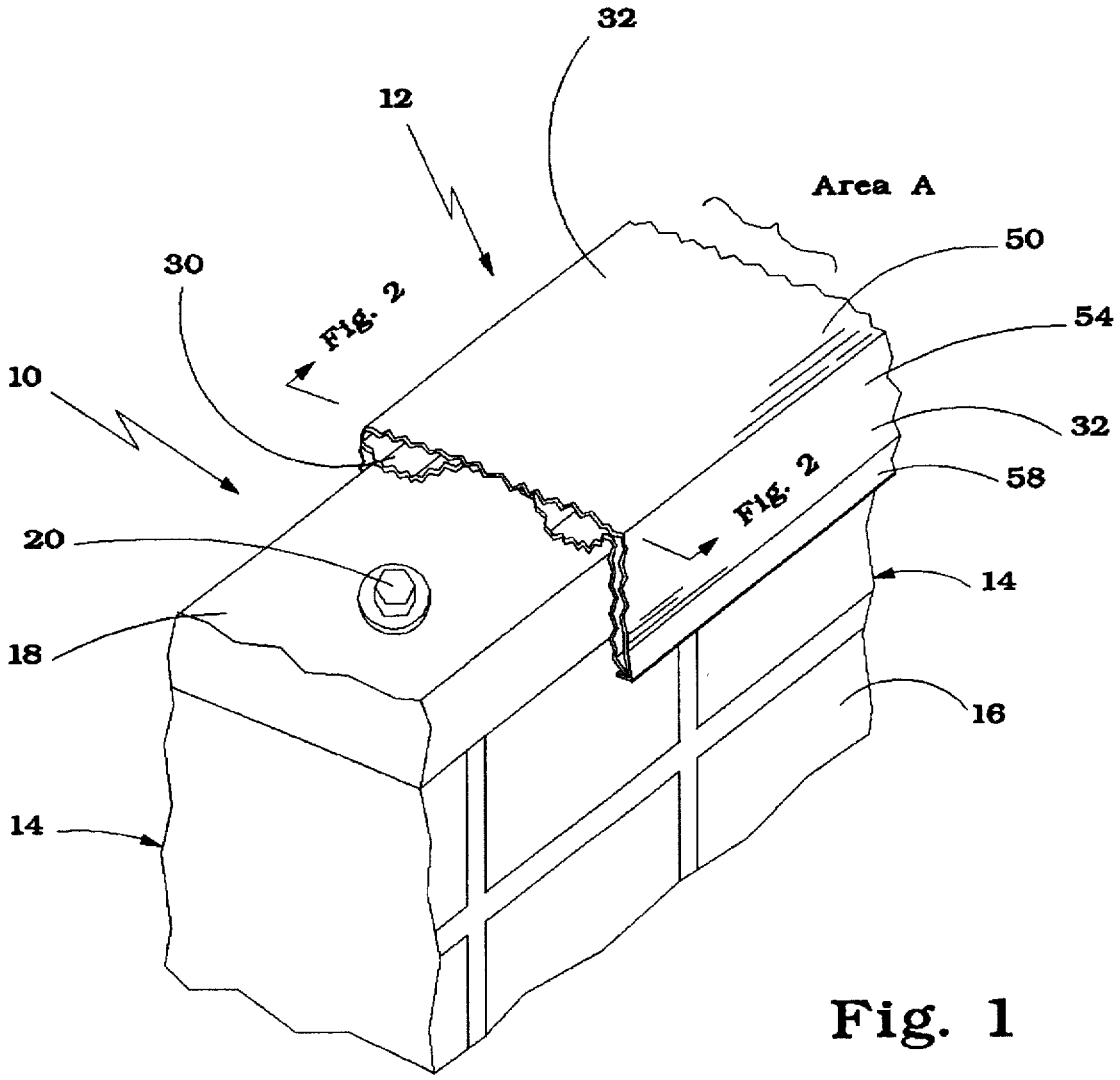
FIG. 1 is a perspective view of a snap-on coping system in accordance with the present invention.

FIG. 1 shows a coping system installation 10 including a coping system 12 and parapet wall 14. In a typical commercial installation, parapet wall 14 is located at the edge of a building roof. The parapet wall 14 is a low-protective wall which extends above the roof surface. Commonly, parapet walls range in heights from 6 to 30 inches. The parapet wall 14 includes a finished wall portion 16 and a top beam 18. Top beam 18 commonly consists of treated lumber and may be secured to finished wall 16 using any commonly known method such as anchor bolts shown at 20. Coping system 12 protects parapet wall 14 by deflecting moisture, while providing an aesthetically pleasing finish to the top of parapet wall 14.

Coping system 12 includes a support member 30 and a coping member 32. Support member 30 and coping member 32 may be formed from conventional roofing materials such as aluminum, galvanized sheet metal, stainless steel, copper, molded plastic, or any other suitable material. It is expected that the support member 30 will be formed from a sheet of suitable material having a thickness from 0.001 to 0.250 inches.

Figure 2:
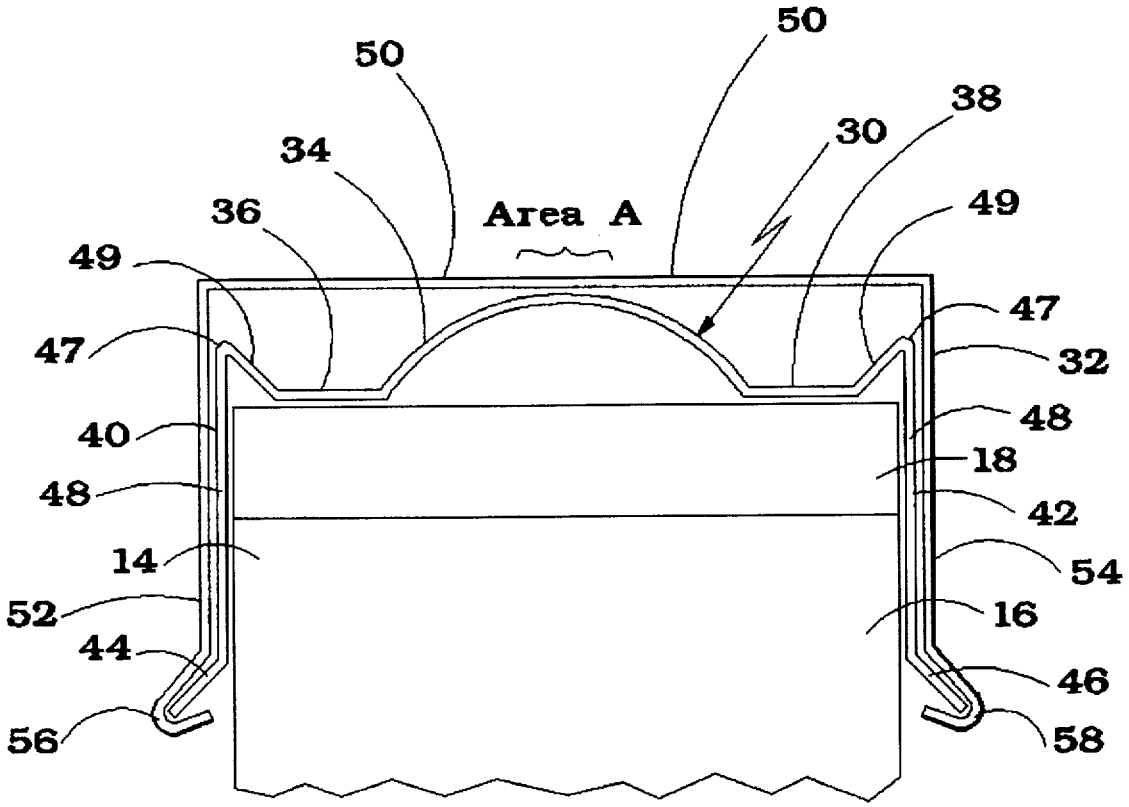
FIG. 2 is a sectional view of the snap-on coping system taken along line 2—2 of FIG. 1.

FIG. 2 is a sectional view showing the coping installation 10 in greater detail. Support member 30 is formed as a single piece and includes a spring support member 34, anchor surfaces 36 and 38, side members 40 and 42, and flared edges 44 and 46. Side members 40 and 42 each include side walls 48 and depending legs 49 joined at a ridge 47 spaced above the anchor surfaces 36 and 38.

In the embodiment shown in FIG. 1 and, in cross section, FIG. 2, spring support member 34 is arcuate, with one end of spring support member 34 extending to anchor surface 36 and an opposite end of spring support member 34 extending to anchor surface 38. Anchor surface 36 and anchor surface 38 are substantially horizontal and parallel to top beam 18. A side wall 48 extends along parapet wall 14 above top beam 18 to a ridge 47 with a leg 49 extending down to anchor surface 36. Flared edge 44 is located at the end of the side wall 48 of side member 40. Similarly, a side wall 48 extends along parapet wall 14 above top beam 18 to a ridge 47 with a leg 49 extending down to anchor surface 38. Flared edge 46 is located at the end of side wall 48 of side member 42.

Support member 30 is secured to top beam 18 at anchor surfaces 36 and 38 by any desired method, such as anchor bolts and conventional roofing nails. Anchor bolts 20 are illustrated. Additionally, support member 30 may be secured to top beam 18 using roofing nails or other fasteners through side walls 48 of side members 40 and 42.

Coping member 32 is formed as a single piece and includes top surface 50, sides 52 and 54 and hook edges 56 and 58. Top surface 50 is a substantially horizontal surface which, when installed, is substantially parallel to top beam 18. Top surface 50 extends between sides 52 and 54. Hook edge 56 is located at the end of side 52, and hook edge 58 is located at the end of side 54. As described and shown, coping member 32 may correspond to that known to the prior art, the noted Castle patent, for example.

When installing coping system 12 on parapet wall 14, support member 30 is positioned over top beam 18, and secured to parapet wall 14 at anchor surface 36 and anchor surface 38 (and through side walls 48, if desired). Next coping member 32 is "snap-fit" over support member 30. When placing coping member 32 over support member 30, top surface 50 comes in contact with spring support member 34 shown at area A. It is recognized that if support member 30 and coping member 32 are made of metal, they should be formed as similar metals to avoid problems such as electrolysis. By pushing down on spring support member 34 at area A, spring support member 34 "gives", allowing hook edge 56 to snap-fit around flared edge 44, and hook edge 58 to snap-fit around flared edge 46. Once the coping member 32 is in place over the support member 30, spring support member 34 continues to provide upward support tension on coping member 32 along area A. Ridges 47 limit the deflection of the corners of coping member 32 during installation and after.

The spring support member 34 is resilient, and "gives" or "flexes" when force is applied to it, while "springing" or returning to its original form when force is removed. The remaining members of support member 30 remain stationary due to being anchored to parapet wall 14—at anchor surfaces 36 and 38, for example. When coping member 32 is positioned as by being "snap-fit" over support member 30 as known in the prior art, support member 30 engages the underside of coping member 32 along its length, providing structural support to the coping system 12.

The coping system installation shown at 10 in FIGS. 1 and 2 is advantageous in that support member 30 may provide continuous support along the whole length of coping member 32. While providing uniform structural integrity along the entire length of coping member 32, the system of the present invention eliminates problems such as "ponding", which occurs due to the sagging of coping members which are only supported at their ends. Also, the improved coping system described herein is adaptable to conventional coping members which are easily snap-fit over support members constructed in accordance with the present invention. Also, this improved coping system allows the use of longer lengths for the coping members due to the uniform structural support as opposed to the support joints of the prior art which needed to be located at short intervals.

Figure 3:
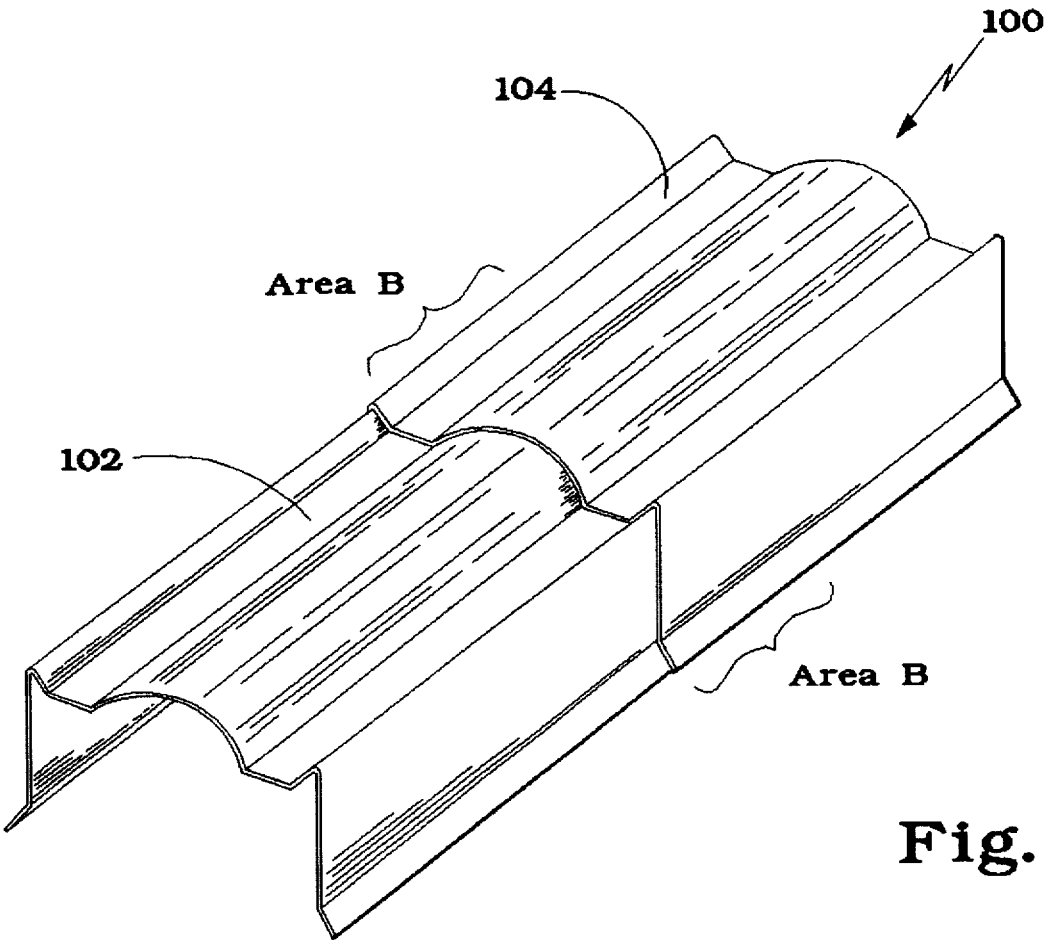
FIG. 3 is a perspective view illustrating a support member of the snap-on coping system illustrated in FIGS. 1 and 2.

It is recognized that at certain points in a coping system installation, the elements forming the coping system will meet at various points called "joints". FIG. 3 shows a coping support member joint at 100 formed between a support member 102 and a support member 104. Support member 104 overlaps support member 102 at support member joint 100, as indicated at area B. Waterproof sealants, such as silicone sealant, butyl sealant or neoprene gaskets, may be used between the members 102 and 104 to provide a seal. Such an installation continues to provide uniform structural support along a length of coping member. It is also recognized that other conventional methods may be used for sealing coping system joints.

Figure 4:
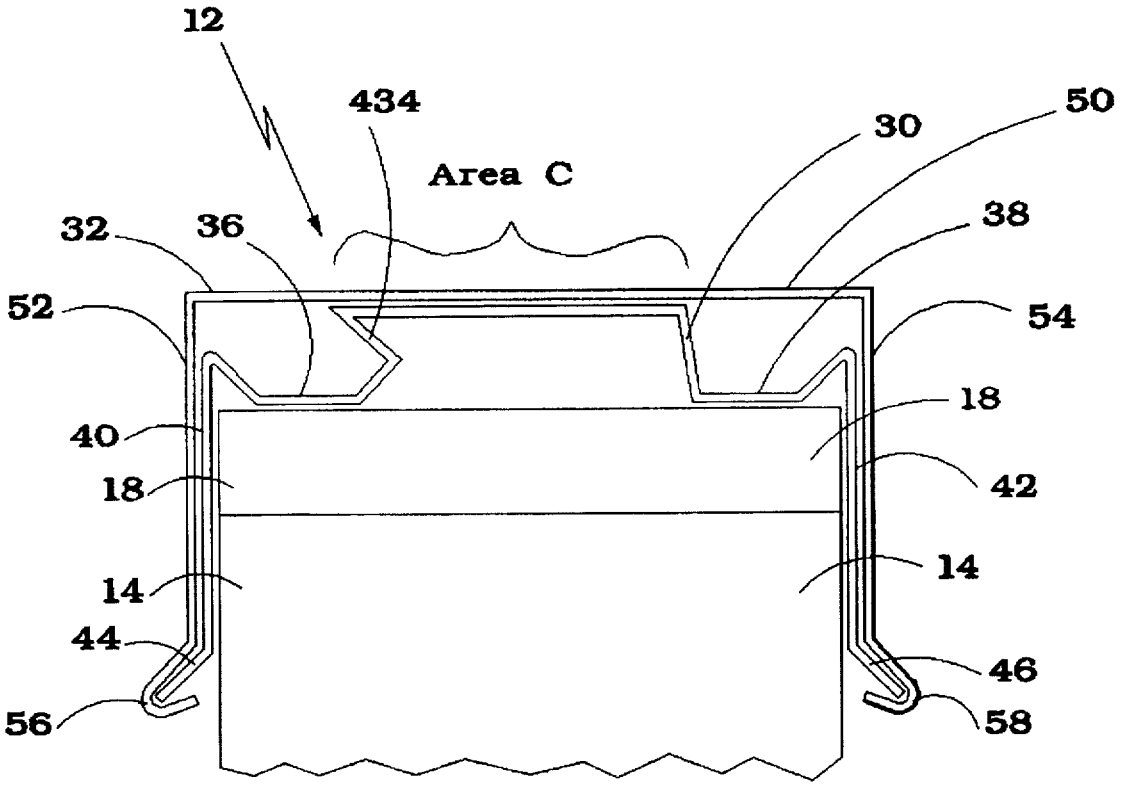
FIG. 4 is a sectional view of a second embodiment of a snap-on coping system in accordance with the present invention

The support member 30 of FIGS. 1—3 may vary in shape and still function to provide continuous support to a coping system. For example, one such alternative or second embodiment is shown in FIG. 4 which includes a flex or compression element 434 which provides spring support similar to that of the spring support member 34 shown in FIGS. 1 and 2. Spring support member including flex element 434 provides a greater support area to coping member 32 shown at area C. When coping member 32 is "snap-fit" over support member 30', the spring support member including flex element 434 engages coping member 32 along its length providing support to coping system 12.

A third alternative embodiment is shown in FIG. 5 as support member 30". Anchor surface 36 and anchor surface 38 are substantially horizontal and parallel to top beam 18. A side wall 48 extends along parapet wall 14 above top beam 18 to a ridge 47 with a leg 49 extending down to anchor surface 36. Flared edge 44 is located at the end of the side wall 48 of side member 40. Similarly, a side wall 48 extends along parapet wall 14 above top beam 18 to a ridge 47 with a leg 49 extending down to anchor surface 38. Flared edge 46 is located at the end of side wall 48 of side member 42. Elements 62 and 66 are joined at ridge-shaped flex joints 64 and 68. From anchor surface 36, leg 62 extends up to a joint 64 with a leg 66 extending down to joint 68. Joint 68 is spaced above the anchor surfaces 36 and 38. Similarly, leg 62 extends up from anchor surface 38, to joint 64 with a leg 66 extending down to joint 68.

Flex Joints 64 and 68 are preferably formed integrally with legs 62 and 66 from a resilient material as by bending or forming a unitary sheet of material. Flex joint 68 together with legs 66 form a "compression spring element" as shown in area D to deform elastically under the urging of a force such as that imparted by securing coping member 32. When coping member 32 is "snap-fit" over support member 30", the resilient compression spring element compresses such that ridges 64 move closer in proximity (toward each other) thus imparting a resisting force or stress to legs 62. Due to legs 62 being fixed at one end at anchor surfaces 36 and 38, this stress results in an upward urging on coping member 32 along ridges 64 (see area D) where the ridges 64 engage the coping member 32. That is, the compression spring element shown in area D engages the coping member 32 along its length. The compression spring element of area D compresses to allow engagement of the hook edges 56 and 58 over the flared edges 44 and 46. After placement of the coping member, the compression spring element of area D expands to provide support to coping member 32.

A fourth alternative embodiment is shown in FIG. 6. The difference between the embodiments of FIG. 5 and FIG. 6 is that the latter has legs 49' parallel with side walls 48. In FIG. 6, a side wall 48 extends along parapet wall 14 above top beam 18 to a ridge 47' with a leg 49' extending down to anchor surface 36'. Similarly, a side wall 48 extends along parapet wall 14 above top beam 18 to a ridge 47' with a leg 49' extending down to anchor surface 38'. The alternative embodiment shown in FIG. 6 is functionally equivalent to that shown in FIG. 5.

The coping system described above may be employed to provide continuous support along the full length of the coping member. Problems such as "ponding" which occurs due to the sagging of coping members which are only supported at their ends, is eliminated. Also, a coping system in accordance with the present invention is adaptable to conventional coping members which are easily snap-fit over support members. Further, the improved coping system described herein allows the use of longer lengths of coping due to the uniform structural support. The novel coping system has fewer manufactured parts, having only a support member and a coping member.

It will be understood that this disclosure is, in many respects, only illustrative. Changes may be made in details, particularly in matters of shape, size, and arrangement of parts, without exceeding the scope of the invention. For example, the coping system support member may take on any shape or form, which continues to provide a spring action for attaching the snap-on coping member, while providing continuous support along the length of the coping member. Also, it is recognized that the coping member itself may take on many structural or decorative shapes and sizes. For example, the substantially top horizontal surface area may be peaked or may be slanted in one direction for directing moisture runoff. The support member may consist of one formed piece or an assembly of joined pieces. Accordingly, the scope of the invention is as defined in the language of the appended claims.

What is claimed is:

1. A wall coping system including a unitary coping member, the coping system being anchored to a wall, the wall coping system comprising:

support means underlying the unitary coping member, the support means including continuous compression spring means engaging the coping member along its length for providing continuous central support to the unitary coping member along its length.

2. The wall coping system of claim 1, further including attachment means integral with the coping member for securing the coping member to the support means.

3. The wall coping system of claim 1, wherein the coping member is adapted to be snap-fit over the support means.

4. The wall coping system of claim 1, wherein the compression spring means provides support and generally continuous upward urging on the coping member along its length, the compression spring means being compressed during positioning of the coping member over the support means.

5. A wall coping system which comprises: a unitary coping member;

continuous compression support means underlying the unitary coping member and engaging the coping member along its length for providing continuous central support to the unitary coping member along its length;

means for securing the coping member to the support means; and anchor means for securing the support means to a parapet wall.

6. The coping system of claim 5, wherein the coping member is adapted to be snap-fit over the support means.

7. The wall coping system of claim 5, wherein the compression support means includes spring means engaging the coping means along its length.

8. The wall coping system of claim 5, wherein the compression support means provides support and generally continuous upward urging on the coping member along its length, the compression spring means being compressed during securement of the coping member over the support means.

* * * * *